US005309413A

United States Patent [19]

Chan

[11] Patent Number: 5,309,413

[45] Date of Patent: May 3, 1994

[54] METHOD, INTEGRATED CIRCUIT, MECHANICAL ANALOG CLOCK MOVEMENT AND COMPLETED ASSEMBLY FOR A TALKING ANALOG CLOCK

[75] Inventor: Shiu L. Chan, Los Altos Hills, Calif.

[73] Assignee: ESS Technology, Inc., Fremont, Calif.

[21] Appl. No.: 102,140

[22] Filed: Aug. 3, 1993

[51] Int. Cl.[5] ..... G04B 21/08; G04B 23/02; G04B 19/04

[52] U.S. Cl. ..... 368/63; 368/74; 368/80; 368/187

[58] Field of Search ..... 368/76, 80, 82, 63, 368/72-74, 223

[56] References Cited

U.S. PATENT DOCUMENTS

| | | | |
|---|---|---|---|
| 3,919,834 | 11/1975 | Murakami | 368/63 |
| 4,073,133 | 2/1978 | Earls et al. | 365/63 |
| 4,470,707 | 9/1984 | Chambon et al. | 368/74 |
| 4,531,841 | 7/1985 | Puff | 368/63 |
| 4,280,209 | 7/1981 | Mooney | 368/71 |
| 4,799,890 | 1/1989 | Thomeson et al. | 368/63 |
| 5,239,523 | 8/1993 | Chin-Hsing | 368/63 |

*Primary Examiner*—Vit W. Miska
*Attorney, Agent, or Firm*—Thomas E. Schatzel

[57] ABSTRACT

A talking analog clock comprises an analog mechanical clock movement in which the minutes mechanism has attached to it a switch that opens and closes for each minute elapsed. A digital synchronizing circuit is included that senses the closing and opening of the switch and uses these events to increment a digital time-keeping circuit. A directional switch attached to a winding stem and connected to the digital synchronizing circuit allows the digital time-keeping circuit to be incremented or decremented with the winding stem. The time in the current time memory is thereafter locked in synchronization with the analog time shown on the display dial. A user can therefore set the time or an alarm time in a simple way.

21 Claims, 4 Drawing Sheets

METHOD, INTEGRATED CIRCUIT, MECHANICAL ANALOG CLOCK MOVEMENT AND COMPLETED ASSEMBLY FOR A TALKING ANALOG CLOCK

BACKGROUND OF THE INVENTION

1. Field of the Invention

The present invention relates generally to clocks and semiconductor devices, and more particularly to clocks with traditional hands and dials that can periodically announce the time with a speech synthesizer and integrated circuits suitable for interfacing to mechanical movements that include speech synthesizers.

2. Description of the Prior Art

Clocks can generally be divided into two types, analog and digital. The analog clock has the familiar twelve-hour dial and arms that sweep the dial to indicate hours and minutes. An arm to indicate seconds is sometimes included. Digital clocks generally have a six digit numeric readout, two for hours, two for minutes and two for seconds. Both types can have an alarm function and a date calendar function.

Analog clocks have traditionally had mechanical movements and digital clocks have conventionally included crystal-controlled digital circuits with seven-segment liquid crystal displays (LCD). Digital logic can be used to drive an analog clock dial, and mechanical movements have been produced that rotate a system of wheels with numbers painted on them to simulate a digital readout.

Presently there are two types of talking clocks using speech synthesizers, digital and analog. Depending on the type of speech synthesizer involved, the construction and announcement of a message can involve piecing together the particles of speech, phonemes, or whole words and phrases from a library of sounds stored in computer memory. An announcement of the time then involves selecting a phrase that corresponds to the time of day.

In a digital clock with a conventional digital timekeeping circuit. synchronizing and interfacing the speech unit to the clock mechanism is a relatively straightforward process of digital logic design. The implementation of such a system can be done in a cost-effective implementation that can be offered on the mass market throughout the world. The prior art includes several examples of digital talking clocks that have been marketed to users who want to hear the time announced periodically. Digital talking clocks are available with a choice of several languages, e.g., English, Spanish, German, French, Mandarin and Japanese. Sounds other than spoken words have also been included, for example, rooster crows have been used for the alarm function.

However, synchronizing and interfacing a speech synthesis unit to an analog clock with a traditional mechanical movement is not as easy.

SUMMARY OF THE INVENTION

It is therefore an object of the present invention to provide an analog clock having a mechanical movement with a synchronized speech unit.

It is a further object of the present invention to provide a synchronizing device to interface an analog mechanical clock movement to a speech synthesizer unit.

It is another object of the present invention to provide a talking analog clock that is inexpensive to manufacture.

Briefly, a talking analog clock embodiment of the present invention comprises an analog mechanical clock movement in which the minute gear mechanism has attached to it a switch that opens and closes generating electronic timing pulses. A digital synchronizing circuit is included that senses the closing and opening of the switch and uses these events to increment a digital timekeeping circuit. A directional switch attached to a winding stem and connected to the digital synchronizing circuit allows the digital timekeeping circuit to be incremented or decremented with the winding stem so that a user can set the time or alarm time in a simple way.

An advantage of the present invention is that a talking analog clock is provided that is very cost effective to manufacture.

Another advantage of the present invention is that a talking analog clock is provided that has its speech-synthesized announcements synchronized with its analog movement.

An advantage of the present invention is that a synchronizer is provided that interfaces a digital time-keeping circuit to an analog clock movement.

These and other objects and advantages of the present invention will no doubt become obvious to those of ordinary skill in the at after having read the following detailed description of the preferred embodiment which is illustrated in the various drawing figures.

IN THE DRAWINGS

DETAILED DESCRIPTION OF THE PREFERRED EMBODIMENT

Figure 1:
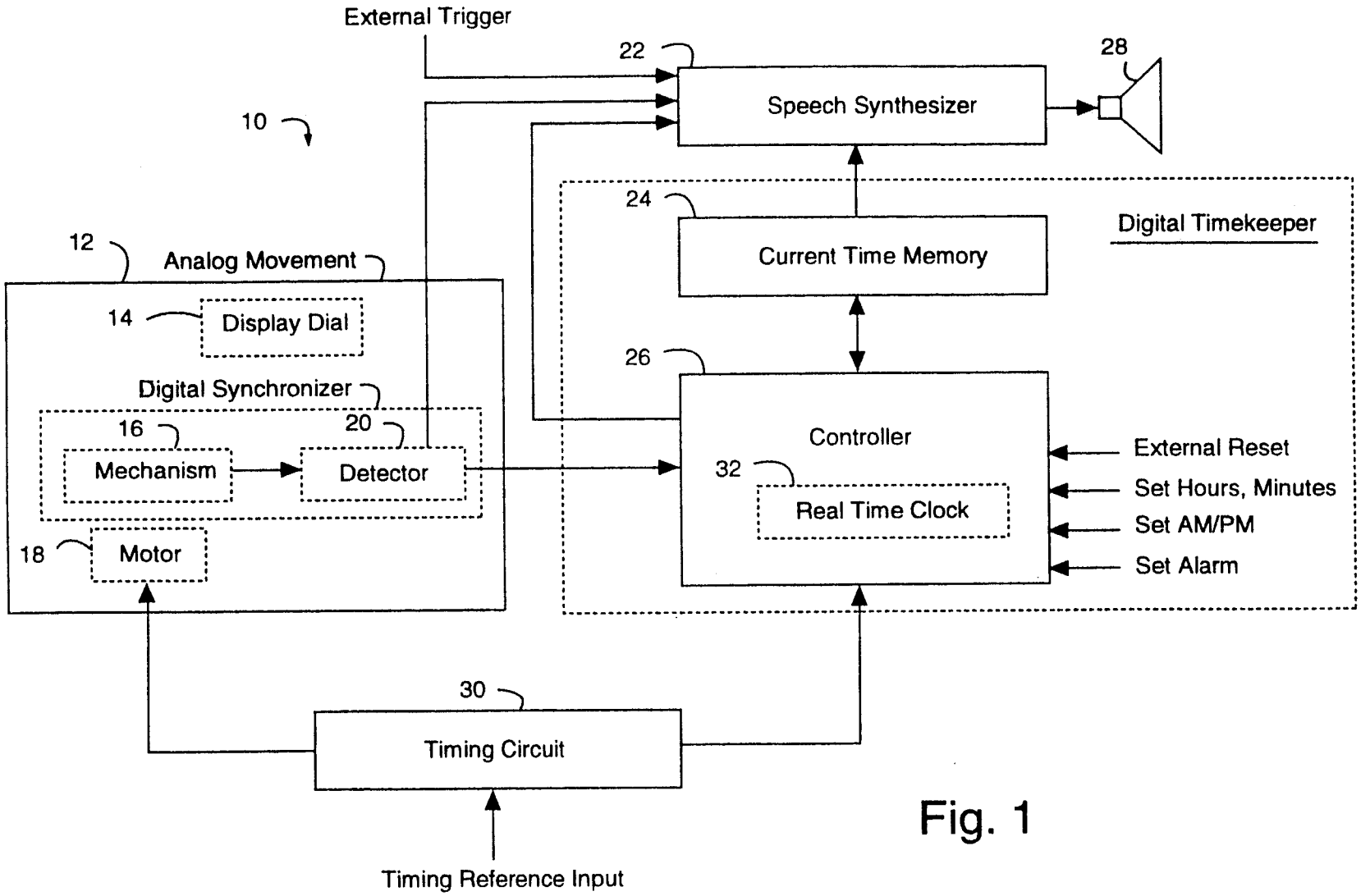
FIG. 1 is a functional block diagram of a talking analog clock embodiment of the present invention.

FIG. 1 is a functional block illustration of a talking analog clock embodiment of the present invention, referred to herein by the general reference numeral 10. Clock 10 includes a movement 12 having a display dial 14 that is driven by a mechanism 16 and a motor 18. A detector 20 senses the turning of a minutes hand and/or gear within mechanism 16 and provides a direction signal and a tick for each advancement. The direction signal is necessary for tracking the direction the user turns the minute hand. A speech synthesizer 22 provides for spoken announcements of the times indicated on the display 14. A memory 24 stores current time data.

A user may increment and decrement the minutes and hours data individually by externally-provided setting controls. A controller 26 can read, write and modify data within memory 24, e.g., to advance a time-of-day representation by a minute. The detector 20 is polled by controller 26 or interrupt drives it to advance the data in memory by one unit, e.g., one minute. Controller 26 may comprise a microprocessor or equivalent. A speaker 28 outputs a series of spoken time announcements of time from speech synthesizer 22, either triggered externally such as by a push button whenever the user wants the clock to say the time, or triggered by an alarm hand and detector in the analog movement, or as stimulated by controller 26. A periodic pulse to drive motor 18 and to pace controller 26 is output by a timing circuit 30.

A single integrated circuit (IC) may be comprised of speech synthesizer 22, memory 24 and controller 26. A microcomputer with integral RAM and ROM memory may be used for memory 24 and controller 26 in a digital timekeeping function. The timing circuit 30 may be alternatively included in the IC. User access is provided to set the hours, minutes, AM/PM and alarm functions. An external reset is also desirable.

Automatic time synchronization and error correction can be obtained by alternatively adding a real time clock (RTC) 32 that can be compared to the current time memory 24 by controller 26. This makes it possible to detect and correct time differences automatically and provide a means to warn and notify a user.

The present invention includes a method of synchronizing a digital timekeeping circuit to an analog clock movement with a digital synchronizing circuit so that once a time reference in a current time memory is set within the digital timekeeping circuit, the time reference will automatically follow the analog clock movement in synchronization thereafter. Synchronization can be accomplished by either setting both the analog time and current time memory to the same time reference, e.g., twelve o'clock or zero, respectively using the winding stem and reset, or by setting the current time in the memory using the hour and minute controls to match the time shown on the analog display dial.

With the flexibility afforded by controller 26, it is possible to also include in the method an optional step of announcing "AM" and "PM" or twenty-four hour mode with the digital speech synthesizer 22 from the current time memory 24 which keeps twenty-four hour time internally, while the analog movements run through twelve hour cycles. Even though clock 10 and analog movement 12 may be twelve-hour cycle types, controller 26 can nevertheless track time in whole day twenty-four hour cycles making it possible to alarm appropriately in "AM" or "PM".

Figure 2:
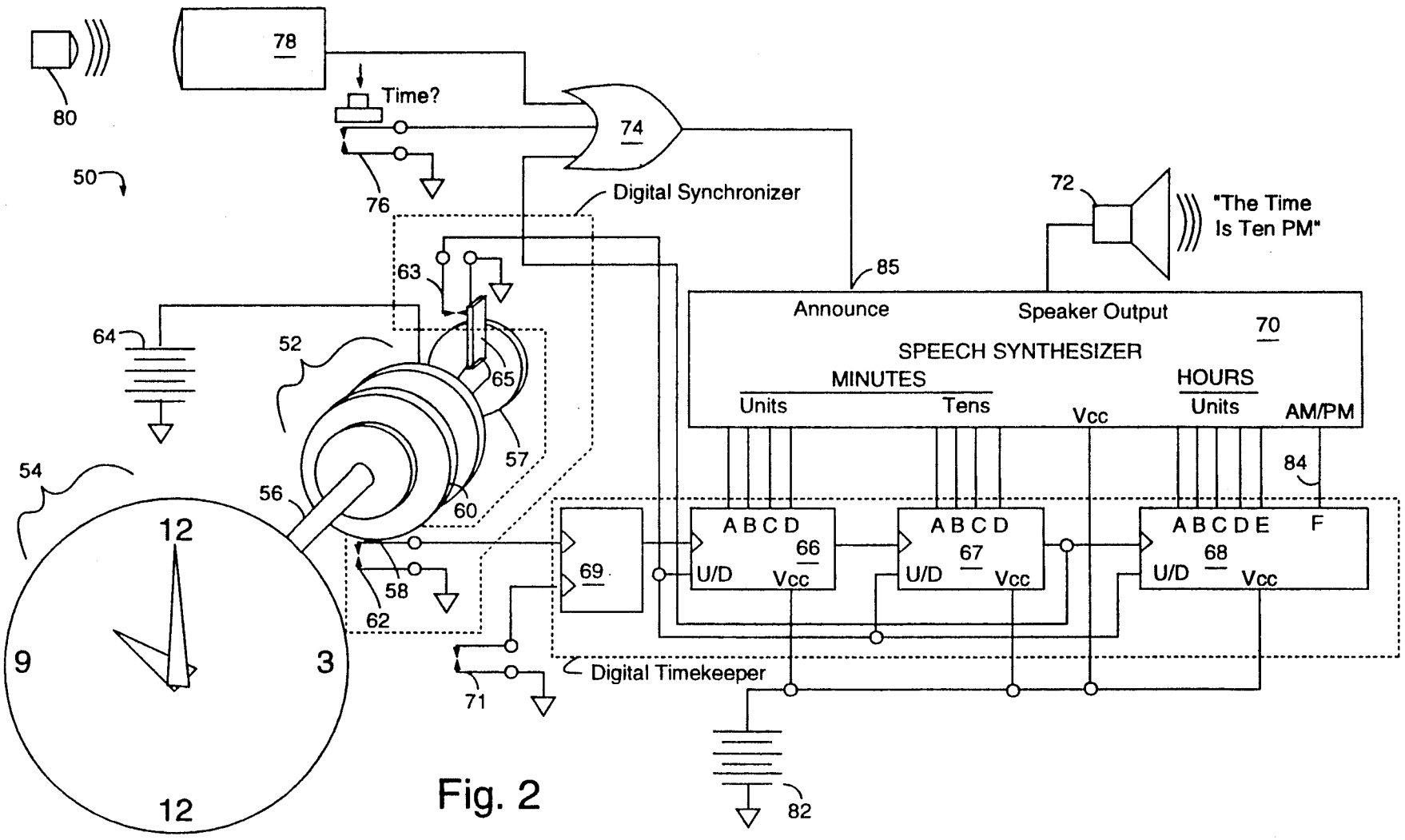
FIG. 2 is a schematic diagram of a talking analog clock similar to that of FIG. 1, and includes a winding stem and AM/PM functions.

FIG. 2 illustrates a talking analog clock embodiment of the present invention, referred to herein by the general reference numeral 50. Clock 50 is similar to clock 10. The clock 50 comprises a mechanical clock movement 52 that drives an analog clock dial 54 through a system of axles 56. A winding stem 57 is coupled to the movement 52 and allows a user to set the time on dial 54. A minutes gear 60 operates a minutes switch 62 once each minute of time while movement 52 is operating. A direction switch 63 is located near winding stem 57. A photo-detector or other means may be used to detect rotations of the minute gear 60 and may be tied into axle 56 or dial 54 instead. A battery 64 powers movement 52. A paddle 65 is slip-mounted to winding stem 57 such that advancing the time on dial 54 with winding stem 57 will force direction switch 63 to close. Turning winding stem 57 in the opposite direction will keep direction switch 63 open.

A digital portion of clock 50 includes a set of three binary coded decimal (BCD) up/down counters 66–68 for serial-in, parallel-out counting, a three-input switch contact de-bouncer 69, a speech synthesis unit 70, a digital time set switch 71, a loudspeaker 72, an OR-gate 74, a pushbutton "TIME?" switch 76 and an infrared receiver 78 with a matching transmitter 80. A battery 82 powers the digital portion apart from the analog clock movement 52. The digital components may be integrated into a single semiconductor device or constructed from conventional, discrete components.

Counter 66 divides by ten, counter 67 divides by six and counter 68 divides by twelve. Thus, the sixty minutes in an hour are represented by BCD outputs from counters 66 and 67 as 0000,0000 through 101,1001. The twelve hours of the day are represented by the five-bit BCD outputs of counter 68 as 00000 through 10010. An AM/PM output 84, e.g. a divide by twenty-four output, provides a day or night time indication to speech synthesis unit 70 for the announcement of "AM" or "PM". For example, output 84 may represent "AM" with a LOW logical state, and "PM" with a HIGH logical state.

Switch de-bouncer 69 preferably has built-in pull-ups for contacts 62 and 71. Any tendencies of contacts 62 and 71 to give other than a good clean switch closure and opening are electrically removed so that the output of de-bouncer 69 provides one digital pulse to counter 66 for each closure and opening of contacts 62 and 71.

The two separate batteries 64 and 82 allow the mechanical analog portion of clock 50 to be decoupled from the digital portion. Whenever one or the other of the batteries is changed, there will need to be a manual re-synchronization of the time-keeping function of counters 66–68 with clock dial 54. Once a user sets the clock dial 54 to the proper time with winding stem 57, switch 71 is then manipulated by the user until the counters 66–68 have advanced far enough that speech synthesis unit 70 announces the correct time. Thereafter, switch 62 will pace counters 66–68 correctly with clock dial 54.

A connection between "TIME?" switch 76 and speech synthesis unit 70 allows a user to prompt an announcement of the time to be spoken by signaling speech synthesis unit 70 at an announcement input 85.

More complex circuits and pushbuttons can be added to simplify a users task in setting the time or an alarm function. For example, another switch can be added to stimulate counter 68 so that the setting of the time-keeping function of counters 66–68 goes quicker than would otherwise be the case by just incrementing the minutes with switch 71.

An analog clock movement that includes a seconds function and/or alarm can be used as a substitute for movement 52.

It will also be apparent from the present disclosure that automatic means to re-synchronize the analog clock dial with the digital time-keeping can be further included. For example, clock 50 may further include a secondary hour position switch on movement 52 to detect the twelve o'clock position of the hours hand. A digital comparison circuit could also be included to compare the current time value of the digital time-keeping circuit to twelve o'clock.

Clock 50 (FIG. 2) may further include within the analog clock movement 52 an alarm that can be set by a user with the winding stem 57. Clock movement 52 is a conventional twelve-hour type. A second alarm function, one that provides for a single alarm within a twenty-four hour period, is included within speech synthesizer 70. The alarm time for this second alarm is set with external controls, such as switch 71, and the AM/PM output 84 allows the alarm function to distinguish between AM and PM.

Figure 3:
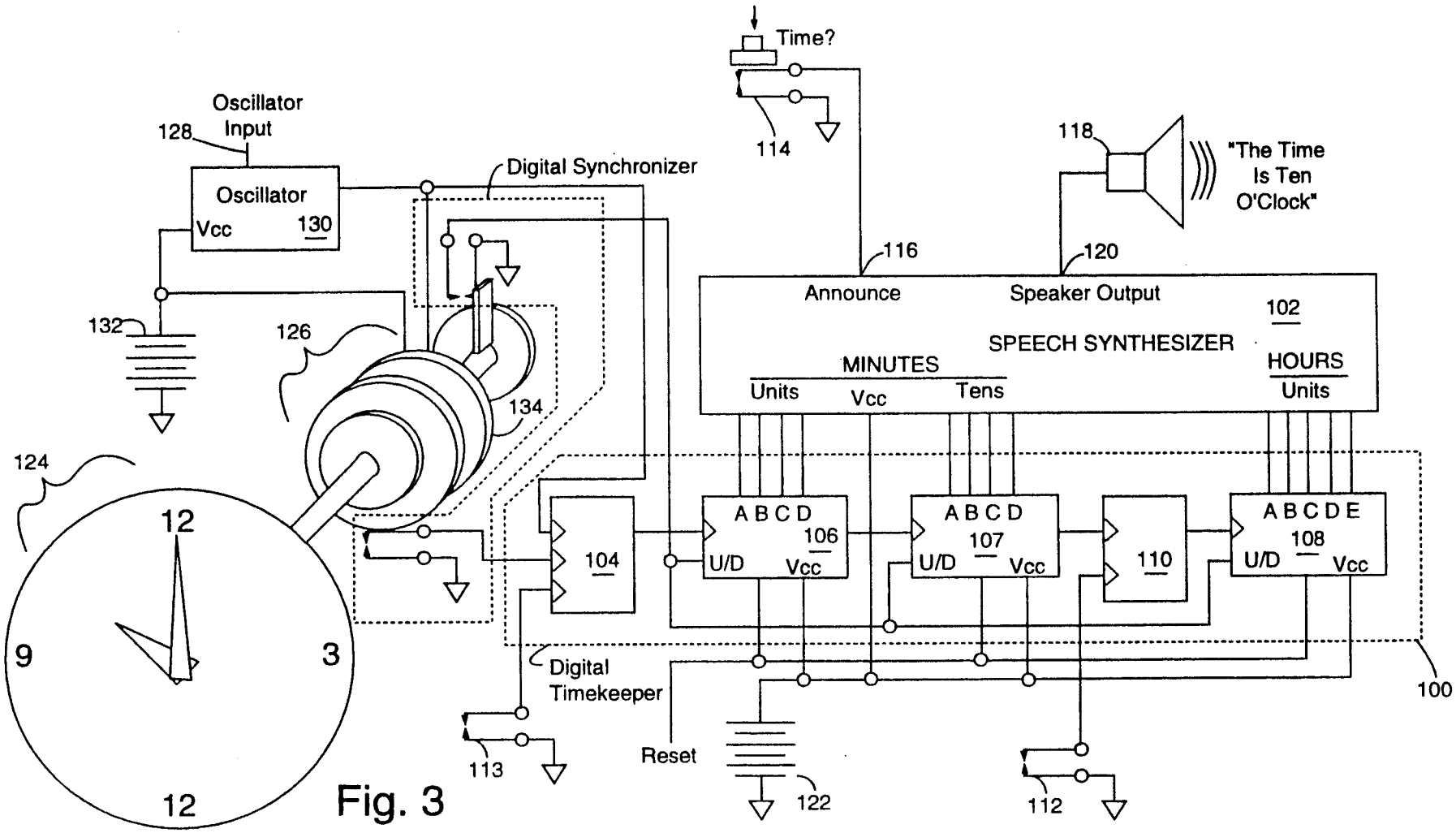
FIG. 3 is a schematic diagram of an integrated circuit embodiment of the present invention for a talking clock with a timing pulse takeoff made directly from a timing unit.

FIG. 3 illustrates an integrated circuit (IC) embodiment of the present invention, referred to herein by the general reference numeral 100. The IC 100 connects to a speech synthesis unit 102 for announcing the time of day and comprises a digital timekeeper assembly which includes a three-input contact de-bouncer 104, a divide-by-ten BCD counter 106, a divide-by-six BCD counter 107, a divide-by-twelve BCD counter 108 and a dual-input contact debouncer 110. A contact 112 allows a user to advance the hours value stored in counter 108. A contact 113 allows a user to advance the minutes values stored in counters 106 and 107. A contact 114 signals an input 116 to prompt the speech synthesis unit 102 to read in the BCD outputs of counters 106–108 and to speak the time through a loudspeaker 118 connected to an output 120. A battery 122 powers IC 100.

Whenever battery 122 is replaced, counters 106–108 reset to zero and a user manipulates contacts 113 and 112 until the time spoken is the correct time.

FIG. 3 also shows an analog clock dial 124 driven by a movement 126. An oscillator input 128 sets the basic timing for a timing unit (oscillator circuit) 130. A battery 132 powers both oscillator circuit 130 and a motor 134 coupled to movement 126. Oscillator 130 outputs timing pulses which are used both by motor 134 to advance the analog movement and by de-bouncer 104 to advance counters 106–108 accordingly.

Figure 4:
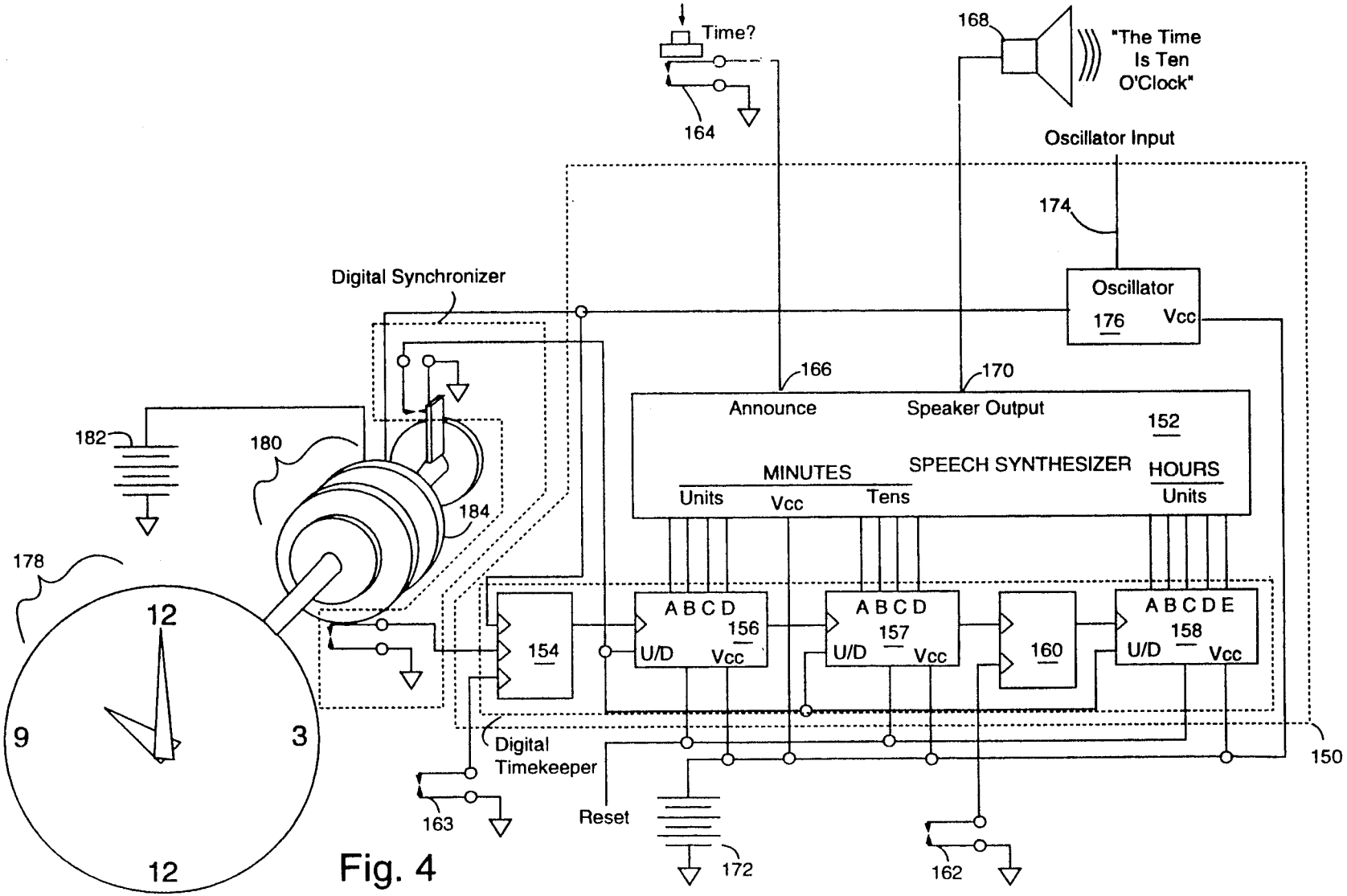
FIG. 4 is a schematic diagram of an integrated circuit embodiment of the present invention for a talking clock that provides a timing unit type output for a mechanical movement.

FIG. 4 illustrates an integrated circuit (IC) embodiment of the present invention, referred to herein by the general reference numeral 150. The IC 150 comprises a speech synthesis unit 152 for announcing the time of day and a digital timekeeping function provided by a three-input contact de-bouncer 154, a divide-by-ten BCD counter 156, a divide-by-six BCD counter 157, a divide-by-twelve BCD counter 158 and a dual-input contact de-bouncer 160. A contact 162 allows a user to advance the hours value stored in counter 158. A contact 163 allows a user to advance the minutes values stored in counters 156 and 157. A contact 164 signals an input 166 to prompt the speech synthesis unit 152 to read in the BCD outputs of counters 156–158 and to speak the time through a loudspeaker 168 connected to an output 170. A battery 172 powers IC 150. An oscillator input 174 sets the basic timing for a timing unit (oscillator circuit) 176.

Whenever battery 172 is replaced, counters 156–158 reset to zero and a user may manipulate contacts 163 and 162 until the time spoken is the correct time.

FIG. 4 also shows an analog clock dial 178 driven by a mechanical movement 180. A battery 182 powers a motor 184 coupled to movement 180. Oscillator 176 outputs timing pulses which are used both by motor 184 to advance the analog movement 180 and by de-bouncer 154 accordingly.

Although the present invention has been described in terms of the presently preferred embodiments, it is to be understood that the disclosure is not to be interpreted as limiting. For example, the term "clock" is intended to include timepieces, watches, chronometers, etc. and is used herein in its broadest sense. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A method of synchronizing a digital timekeeping circuit to an analog clock movement with a digital synchronizing circuit wherein once a time reference in a current time memory is set within the digital timekeeping circuit, the time reference will automatically follow the analog clock movement in synchronization thereafter, the method comprising the steps of:

setting a reference time in said analog clock movement by turning a winding stem included in said movement;

setting said time reference in said current time memory with digital inputs to a controller included in said digital timekeeping circuit;

detecting a minute movement with a minute gear connected to a timing pulse generating circuit;

detecting a turning direction of winding stem with a digital circuit; and incrementing or decrementing according to said turning direction a value representing time in said current memory.

2. The method of claim 1, further including the step of:

setting both an analog time and said current time memory to a single reference by winding said winding stem.

3. The method of claim 1, further including the step of:

turning said winding stem until a desired time is indicated by said analog clock movement; and then setting said current time memory by using a pair of hour and minute setting controls to match a predetermined time as indicated by said analog clock movement.

4. The method of claim 1, further including the step of:

retaining twenty-four hour time in said current memory and providing an AM/PM where said analog clock movement has a twelve hour dial.

5. The method of claim 1, further including the step of:

alarming on "AM" or "PM" or twenty-four hour time while where said analog clock movement has a twelve hour dial.

6. The method of claim 1, further including the step of:

automatically detecting and correcting time differences between said current time memory and a real time clock associated with said digital timekeeper.

7. A talking analog clock, comprising:

a mechanical analog clock movement that includes a minutes mechanism and an hour mechanism;

a minutes switch mechanically coupled to said minutes mechanism for providing a switch contact closure in response to a turning motion of said minutes mechanism;

a digital time-keeping circuit having a memory means for storing digital values respectively a time-of-day;

a digital synchronizing circuit electrically connected to the minutes switch and the digital time-keeping circuit and having means for incrementing and decrementing said minutes value for each closure of the minutes switch; and a speech synthesis unit coupled to the digital time-keeping circuit for speaking a phrase responsive to said digital values representing a time-of-day.

8. The clock of claim 7, further comprising:

a winding stem mechanically connected to the mechanical analog clock movement such that a user may turn said minutes and said hour mechanisms;

a directional switch mechanically coupled to the winding stem and having a winding-direction detection switch electrically connected to the digital synchronizing circuit for incrementing or decrementing said current time value according to the direction of the turn, wherein the digital time-keeping circuit is maintained in synchronization with the mechanical analog clock movement.

9. The clock of claim 7, further comprising:

a first battery connected to the mechanical analog clock movement for powering the movement; and a second battery connected to at least the digital time-keeping circuit for powering the digital functions apart from the mechanical analog functions.

10. The clock of claim 7, further comprising:

prompting means connected to the speech synthesis unit for receiving a signal and for stimulating the speech synthesis unit to announce the time then represented by said digital values in response to said signal.

11. The clock of claim 10, wherein:

the prompting means includes an infrared transmitter and receiver.

12. The clock of claim 10, wherein:

the prompting means includes a switch contact provided for a user to tap whenever a spoken time announcement is desired.

13. The clock of claim 10, wherein:

the prompting means includes a switch contact mechanically connected to the analog clock movement for automatic and periodic spoken time announcements.

14. The clock of claim 7, wherein:

the digital time keeping circuit includes a plurality of serial-in, parallel-out up/down counters in cascade with a serial input electrically connected to the minutes switch.

15. The clock of claim 7, further comprising:

a de-bouncer circuit with integral pull-ups for switch contact inputs that is electrically connected between the minutes switch and the digital time-keeping circuit.

16. The clock of claim 7, further comprising:

user digital time setting means coupled to the digital time-keeping circuit for manipulating a digital time as spoken by the speech synthesis unit to match an analog clock time driven by the analog clock movement.

17. The clock of claim 16, further comprising:

a de-bouncer circuit with a pair of integral pull-ups for the minutes switch and user digital time setting means that is electrically connected to the digital time-keeping circuit.

18. The clock of claim 7, further comprising:

an analog dial alarm connected to the mechanical analog clock movement for providing an alarm function in a twelve-hour period and having winding stem means for setting a first alarm time; and a digital time alarm connected to the digital timekeeping circuit for providing an alarm function in a twenty-four-hour period and having user adjustment means for setting a second alarm time.

19. An integrated circuit (IC), comprising:

electrical input means for connection to a minutes switch that is mechanically coupled to a minutes mechanism in an analog clock movement wherein said minutes switch provides a switch contact closure in response to a turning motion of said minutes mechanism;

a digital time-keeping circuit having a storage means for memorizing digital values representing a time-of-day;

a digital synchronizing circuit electrically connected to the minutes switch and the digital time-keeping circuit and having means for advancing said minutes value for each closure of the minutes switch; and a speech synthesis unit coupled to the digital time-keeping circuit for speaking a phrase responsive to said digital values representing said time-of-day.

20. An analog clock movement, comprising:

a mechanical analog clock movement with at least a minutes mechanism and an hour mechanism; and a minutes switch means mechanically coupled to said minutes mechanism for providing a minutes signal output in response to a turning motion of said minutes mechanism to a digital time-keeping circuit having a storage means for memorizing digital values representing a time-of-day and a digital synchronizing circuit electrically connected to the minutes switch means and said digital time-keeping circuit that has time setting means for changing a minutes value and a speech synthesis unit coupled to said digital time-keeping circuit for speaking a phrase responsive to said digital values representing said time-of-day.

21. The analog clock movement of claim 20, further comprising:

a winding stem mechanically connected to the mechanical analog clock movement such that a user may adjust said minutes and said hour mechanisms;

a directional switch mechanically coupled to the winding stem and having a winding-direction detection switch electrically connected to the digital synchronizing circuit for incrementing and decrementing a minutes value accordingly, wherein said digital time-keeping circuit is maintained in synchronization with the mechanical analog clock movement.

* * * * *